United States Patent [19]

Pozzobon

[11] Patent Number: 4,836,572

[45] Date of Patent: Jun. 6, 1989

[54] SKI BINDING, PARTICULARLY FOR CROSS-COUNTRY SKIING

[75] Inventor: Alessandro Pozzobon, Treviso, Italy

[73] Assignee: Nordica S.p.A., Montebelluna TV, Italy

[21] Appl. No.: 43,580

[22] Filed: Apr. 21, 1987

[30] Foreign Application Priority Data

Apr. 30, 1986 [IT] Italy ..... 41562 A/86

[51] Int. Cl.[4] ..... A63C 9/086

[52] U.S. Cl. ..... 280/613; 280/614

[58] Field of Search ..... 280/613, 614, 615, 618, 280/624

[56] References Cited

U.S. PATENT DOCUMENTS

| | | | |
|---|---|---|---|
| 2,172,669 | 9/1939 | Taft | 280/614 |
| 2,649,306 | 8/1953 | Hilding | 280/614 |
| 3,388,918 | 6/1968 | Hollenback | 280/614 |
| 4,273,355 | 6/1981 | Storandt | 280/614 |
| 4,322,090 | 3/1982 | Loughney | 280/615 |
| 4,659,103 | 4/1987 | Tessaro | 280/615 |

FOREIGN PATENT DOCUMENTS

| | | | |
|---|---|---|---|
| 2121815 | 11/1972 | Fed. Rep. of Germany | 280/613 |
| 2338719 | 8/1977 | France | 280/615 |
| 255998 | 7/1948 | Switzerland | 280/614 |

*Primary Examiner*—David M. Mitchell
*Assistant Examiner*—Brian L. Johnson
*Attorney, Agent, or Firm*—Guido Modiano; Albert Josif

[57] ABSTRACT

The binding comprises a plate having a transverse flap located at a first end thereof, and a bar pivotally connected to a second end thereof. A spring is adapted for adjusting oscillation of the bar relative to the plate, the first end whereof is pivotally connected to a base, attachable to a ski. The transverse flap and the bar are adapted for engaging grip elements provided at the sole of an item of footwear. Shoulders protruding from the base rotatably support a hook which is releasably engagable with teeth, rigidly associated with the bar, for selectively preventing oscillation between the plate and the base. A longitudinal lug is also attachable to a ski and accommodatable in a recess formed in the sole of an item of footwear, to prevent lateral movement of the footwear with respect to the longitudinal axis of the ski.

7 Claims, 4 Drawing Sheets

SKI BINDING, PARTICULARLY FOR CROSS-COUNTRY SKIING

BACKGROUND OF THE INVENTION

The present invention relates to a ski binding, particularly for cross-country skiing.

Several types of bindings are currently known for the practice of cross-country skiing, which feature the essential characteristic of locking to the ski, a tip which projects forward from a specific item of footwear worn by the athlete.

Said tip, which is an extension of the sole, deforms resiliently during the stride, allowing to use the alternate-stride method.

Said known types of bindings are not free from disadvantages, among which is the remarkable stress which affects the tip, which is subject to breakage in the region of rigid coupling to the binding.

Another disadvantage resides in the fact that such bindings do not allow a good lateral grip of the footwear, that is, they do not allow the athlete to place the ski edge-wise on the snow.

This disadvantage is relevant, since skiers currently tend to adopt a mixed method comprising, besides the alternate stride, a new method, known as the lateral push stride method.

Said new method gives a better performance in skiing if it is possible to arrange the ski edge-wise or edge-on, imparting thereto a lateral movement in an oblique direction with respect to the direction of the skier's path.

As a partial solution to this problem, bindings are known which are composed of a first element adapted to lock the tip of the item of footwear, and a second element adapted to lock the heel region thereof.

The main disadvantage found in such known types is the high overall cost of the binding, since it comprises two separate elements.

Furthermore, the skier is prevented from adopting the alternate-stride method of skiing.

SUMMARY OF THE INVENTION

The main aim proposed by the present invention is to eliminate the disadvantages described above in known types by devising a ski binding for cross-country skiing which allows the skier to adopt either the alternate-stride or the lateral push stride method of skiing, with maximum results.

Within the scope of this aim, a further important object is to provide a ski binding for cross-country skiing which allows, if the alternate-step method is used, to perform an optimum and safe stride without any part of the footwear being subjected to resilient deformation.

Another important object is to provide a ski binding for cross-country skiing, which allows a skier, when adopting the lateral push-stride method of skiing, to firmly fasten the footwear to the ski.

Another object is to provide a ski binding which allows a quick and optimum fastening and unfastening of the footwear to the ski.

A further object is to provide a ski binding which associates with the above features that of being structurally simple, comprising a small number of components, and requiring little maintenance.

The aim and the objects mentioned above, and others which will become apparent hereinafter, are achieved by a ski binding particularly for cross-country skiing, characterized in that it comprises a base which can be coupled to a ski, a plate pivoted to said base, along an axis which is perpendicular with respect to the longitudinal axis of said ski, for an oscillation of said plate relatively to said base, engagement means for the removable locking of an item of footwear on said plate, means for blocking the oscillation of said plate relatively to said base and control means for the operation of said blocking means.

BRIEF DESCRIPTION OF THE DRAWINGS

Further characteristics and advantages of the invention will become apparent from the description of two preferred, but not exclusive, embodiments, illustrated only by way of non-limitative example in the accompanying drawings, wherein.

DESCRIPTION OF THE PREFERRED EMBODIMENTS

Figure 1:
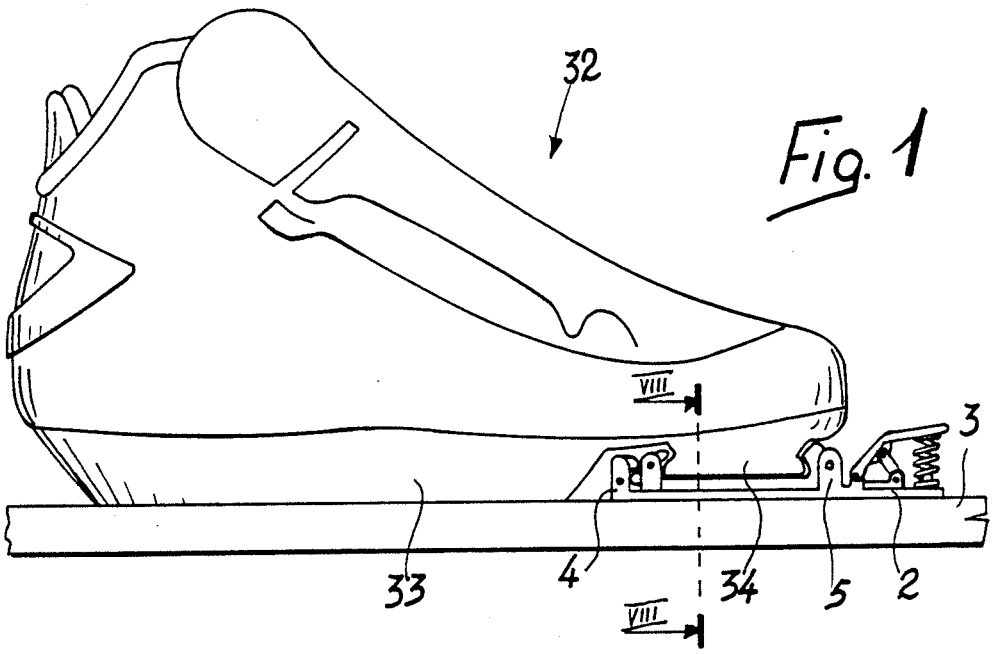
FIG. 1 is a side view of the binding connecting a footwear item to a ski.
Figure 2:
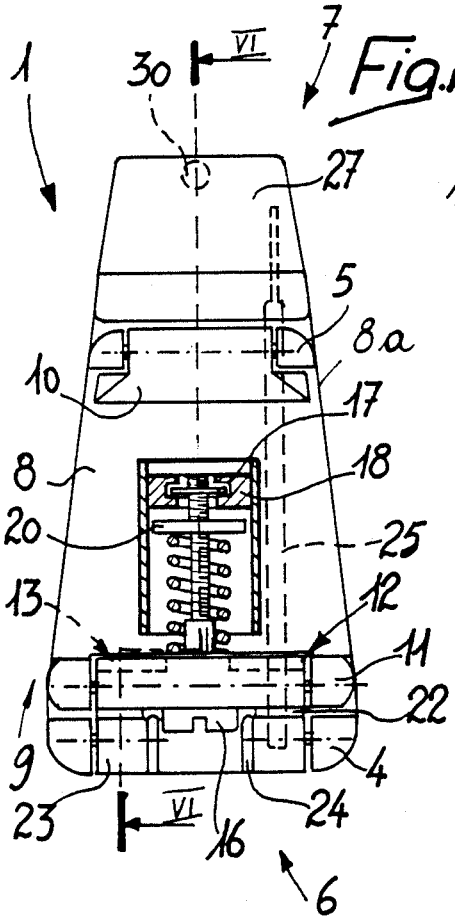
FIG. 2 is a top view of the binding.

With reference to the above described figures, the binding 1 is composed of a plane base 2, advantageously metallic and essentially trapezoidal in shape, which can be rigidly coupled to the surface of a cross-country ski 3. Said base 2 is provided with first and second pairs of lateral shoulders 4 and 5, similar in shape and dimensions, symmetrical with respect to the longitudinal mid-plane of the base 2. The first pair of shoulders 4 project perpendicularly at the rear or first end 6 of the base 2, while the second pair of shoulders 5, is located proximate to the front or second end 7 thereof.

At one end 8*a* a plate 8 is idly pivoted between the shoulders 5. The plate 8 has an essentially trapezoidal shape and rests on the base 2, its other end 9 being adjacent to the shoulders 4.

From said plate 8, at the first end 8*a* thereof pivoted to the base 2, projects a transverse flap 10 which is curved with a concavity facing the pair of shoulders 4.

From the second end 9 of the plate 8 project, a third pair of identical shoulders 11. Between the shoulders 11 a metal bar 12, having a substantially oval cross section, is pivoted idly at a pivot axis, arranged eccentrically with respect to the mid-longitudinal axis of said bar.

In the regions adjacent to the lateral ends of the surface of said bar facing the flap 10 are formed two milled seats 13, each having a surface 14 which is inclined with respect to the plane of the plate 8.

A through hole 15 is formed in the bar 12 above a longitudinal mid-plane of the plate 8 and below the axis of pivotal connection to the shoulders 11. The through hole 15 is inclined with respect to the transverse axis of said bar towards the flap 10.

Figure 9:
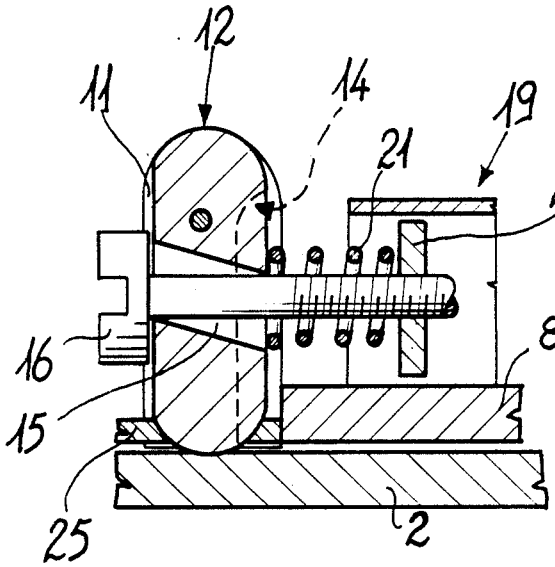
FIG. 9 is a detail view, taken along the mid-longitudinal plane of the binding.

As illustrated in FIG. 9, the stem of a screw 16 is inserted in said hole 15, the head of said screw interacting with the rear surface of the bar 12.

The stem of the screw thus projects towards the flap 10, and is threaded in the region not interacting with the bar 12, its terminal end is blocked in a fixed position and a locking ring 17 is associated therewith.

Said ring is accommodated between two flaps 18 which project from the inner lateral walls of a box-like housing 19 for said stem.

The housing is rigidly connected to the plate 8 and projects therefrom for a height no greater than that of the bar 12 and the flap 10. Said housing is shorter than the longitudinal extension of the plate 8 and its ends are open and do not interact with the bar 12 or with the flap 10.

Inside the housing 19, which has a cross section in the shape of an isosceles trapezium, a nut 20 is provided which is threaded to engage the stem of the screw 16, its lateral surface interacting with the walls of said housing 19.

Such an arrangement allows, by rotating the screw, to obtain only an axial motion of the nut which is prevented from rotating.

Located coaxially with respect to the stem of the screw 16, is a cylindrical helical compression spring 21, the ends of which interact with the surface of the bar 12 facing towards the housing 19 and with a surface of the nut 20.

A tooth 22 projects from the rear surface of the bar 12, at each of the seats 13, the tooth has a plane surface which interacts with the corresponding facing surface of a locking means composed of a hook 23 having an essentially L-shaped cross section.

Each of said hooks is freely and transversely pivoted between a shoulder 4 and a flap 24, projecting perpendicularly with respect to the base 2.

Of course both hooks 23 have the same pivot axis. The surface of the hook interacting with the tooth 22 is arranged on a plane which is intermediate and parallel with respect to the planes, intersecting, respectively, the upper pivot axis of the bar 12 and the lower pivot axis of said hook 23.

Such an arrangement allows the coupling and the uncoupling between the bar and the hook, upon the hook being rotated in one direction or the other.

This rotation is imparted to the hook by means of a pair of rods 25 arranged symmetrically with respect to the longitudinal middle axis of the base 2 on which they rest.

In fact each rod is associated at one end with the end of the corresponding hook 23 adjacent to the base 2, while the other end projects beyond the shoulders 5.

The body of the rods is instead accommodated in complementarily shaped seats provided in the bar 12 and in the plate 8.

The axial motion of each rod is imposed by means of a connecting rod 26, arranged obliquely with respect to the plane of the base 2 and pivoted, at one end, to the matching end of the rod 25 and at the other end to a mid-point of a lever 27.

The lever 27 is in turn pivoted at one end between two flaps 28 which project perpendicularly from the base 2.

Figure 3:
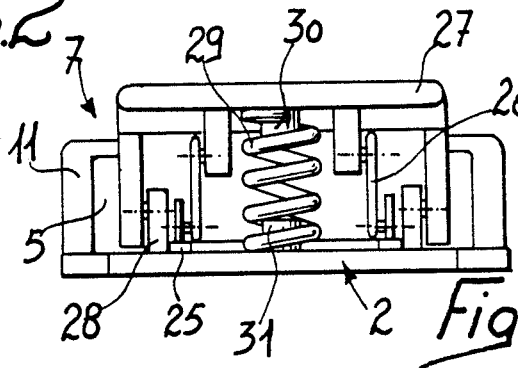
FIGS. 3 and 4 are respectively a front view and a rear view of the same binding.
Figure 4:
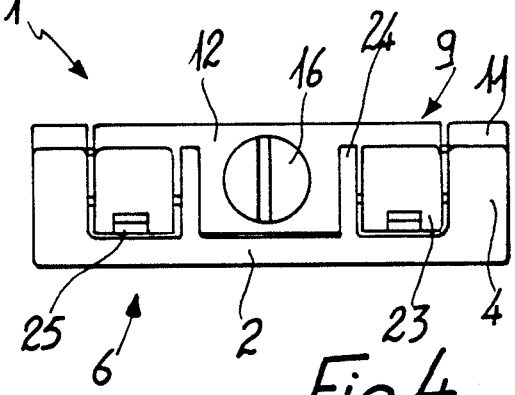
Figure 6:
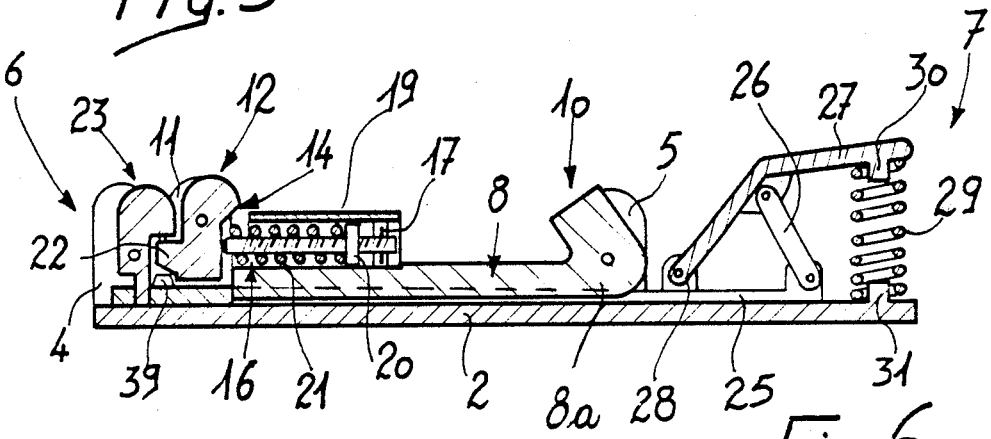
FIG. 6 is a cross section view along the plane VI—VI of FIG. 2.
Figure 7:
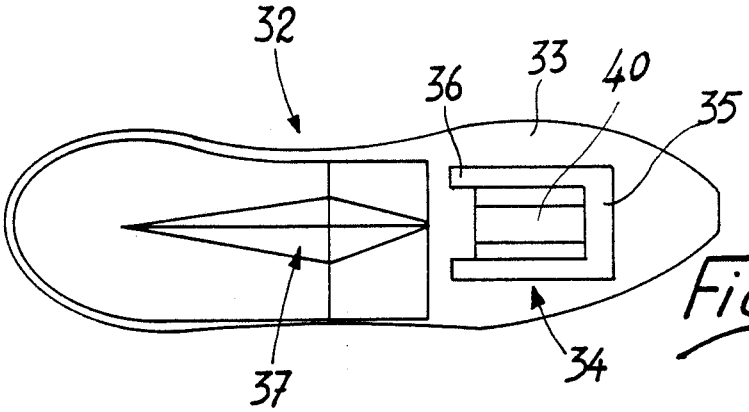
FIG. 7 is a view of the lower surface of the footwear.
Figure 8:
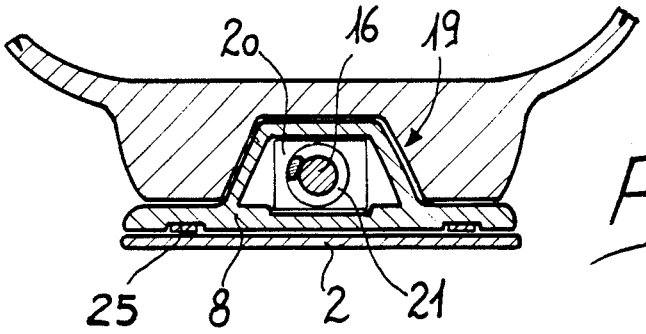
FIG. 8 is a cross section view along the plane VIII—VIII of FIG. 1.

FIGS. 3 and 6 illustrate the condition in which the hook 23 blocks the tooth 22: said condition is kept stable by interposing a cylindrical helical compression spring 29 between the facing surfaces of the lever 27 of the base 2, its ends being arranged coaxially with respect to two cylindrical tabs 30 and 31.

An item of footwear 32 is removably associable with the binding 1, and is provided with a lug 34, below the sole 33 at the region of the tip.

The lug 34 has a central region 40 which is shaped complementarily with respect to the box-like housing 19, and is provided with grip means which are constituted by a transverse tab 35 shaped complementarily with respect to the curved portion of the flap 10 facing towards the rear end 6 of the binding, and by a pair of lateral tabs 36 shaped complementarily with respect to the seats 13 provided on the bar 12.

Along the mid-longitudinal axis of the sole, in the regions of the heel and the middle portion of the sole, a seat 37 is provided which expediently has a triangular cross section. The seat is adapted to accommodate a complementarily shaped longitudinal lug 38 rigidly coupled with and projecting from the ski 3.

To engage the item of footwear 32 with the binding 1, the skier first places the tab 35 in abutment witn the flap 10, then simply exerts pressure on the sole towards the ski.

The tabs 36 are thus positioned in the seats 13, in which they are blocked.

The coupling is possible because the bar 12 can rotate freely about its own axis, due to the angled arrangement of the hole 15.

By rotating the screw 16, it is possible to adjust the pressure required to obtain safety release in case the skier is subject to a fall.

In order to limit the clockwise rotation of the bar 12, as an effect of the action of the spring 21, as shown in FIG. 6, an arrestor tooth 39, rigidly coupled to the base 2, is provided rearwardly thereto.

In order to unfasten the footwear from the binding 1, the skier simply has to raise his/her heel, with a sharp movement, so that the tabs 36, by pushing on the surface 14, cause the rotation, in an anticlockwise direction with reference to FIG. 6, of the bar 12, overcoming the force of the spring 21; this rotation is also facilitated by the tooth 22 which abuts with the hook 23.

Considering now the condition illustrated in FIGS. 1 and 6, therein the plate 8 is associated with the base 2, the hook 23 locking the tooth 22 of the bar 12.

In this manner, the skier can perform the stride according to the lateral push stride method, the footwear being practically adherent to the ski. If instead he wishes to perform the stride according to the alternate-step method, it will be sufficient to push the lever 27 to impose an axial sliding of the rods 25 and therefore the rotation of the hook 23 until it disengages from the tooth 22.

Figure 5:
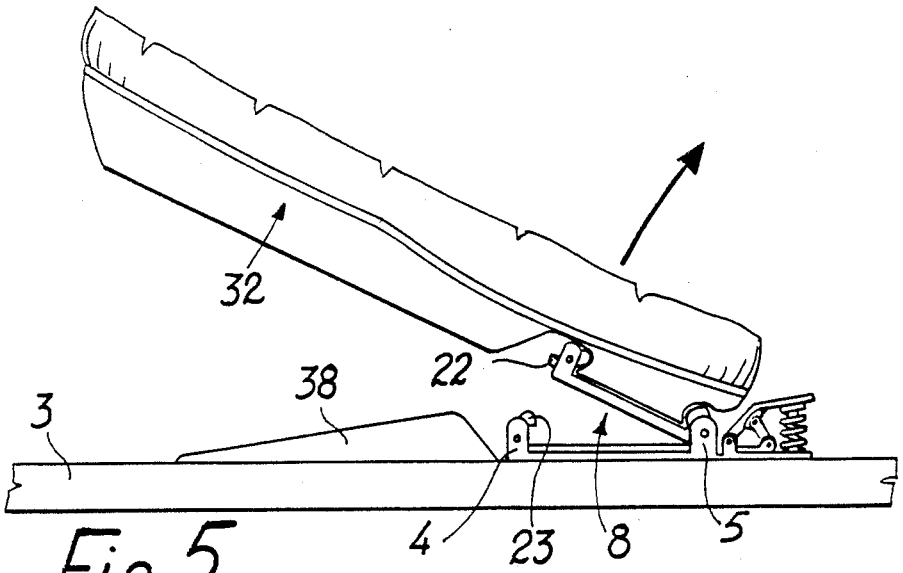
FIG. 5 is a side elevation view illustrating the operation of the binding when performing the alternate-stride method of skiing.

In this manner the plate 8 can rotate around the axis of pivoting at the shoulders 5, as illustrated in FIG. 5.

If the skier wishes to return to the use of the previous method, it will be sufficient to exert a simple pressure on the sole towards the ski, so as to make the hook 23 interact again with the tooth 22.

It has thus been observed that the invention achieves the aims and the objects proposed, a binding for cross-country skiing, having been provided which allows the skier to adopt with the best results both the alternate-stride method and the lateral push stride method.

Figure 10:
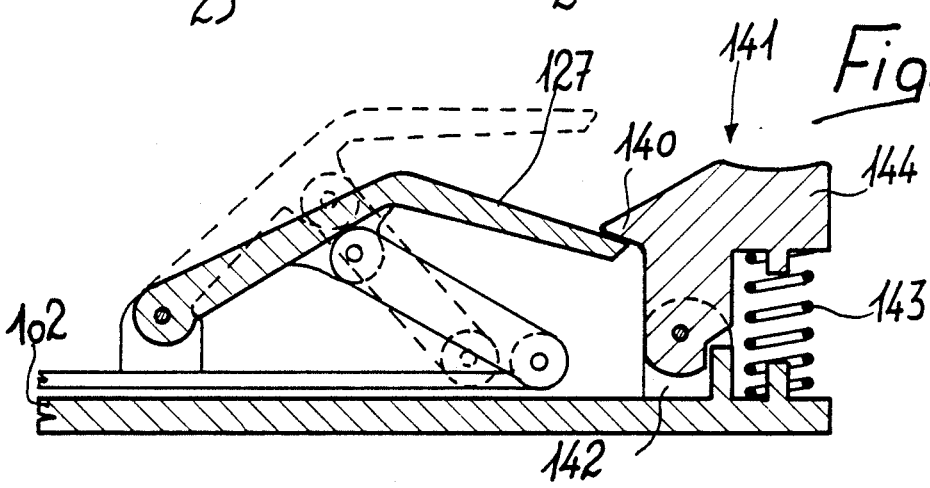
FIG. 10 is a view, similar to the view of FIG. 6, of a means adapted to allow the selection of the method to be adopted while skiing.
Figure 11:
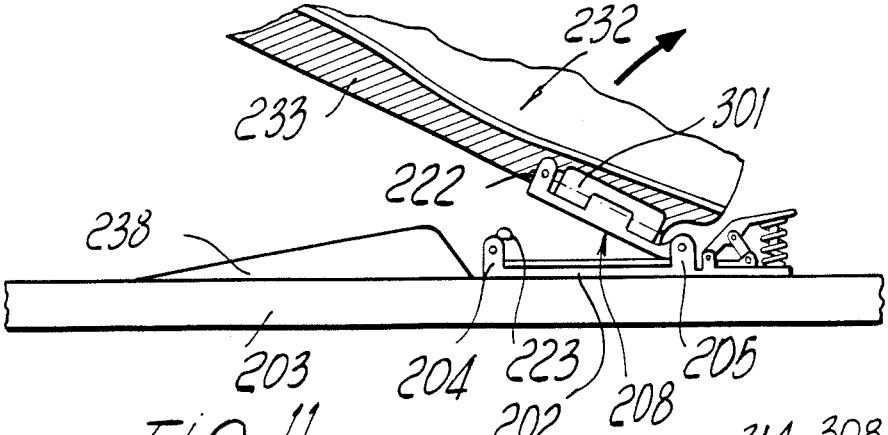
FIG. 11 is a view, similar to the view of FIG. 6, of the binding having a lateral boot engagement system.

Furthermore FIG. 10 illustrates a device adapted to allow the plate 8 not to be locked by the hook 23 each time the skier rests the sole on the ski.

It entails that the free end of the lever 127 interacts with a first flap 140 of a head 141, the stem of which is pivoted between a fourth pair of lateral shoulders 142 mounted on the base 102.

The head is held in position by a spring 143 interposed between the lower surface of its second flap 144 and the facing surface of the base 102.

Once the lever 127 is engaged with the head, the uncoupling of the plate from the base 102 is achieved, while, in the opposite case, the skier can achieve the automatic plate-base coupling by resting the heel on the ski.

FIGS. 11 to 14 illustrate another aspect of the invention, provided with a lateral binding system, wherein the elements which are in common with the device as described above are indicated with the numbers of the previous figures increased by 200.

The lateral binding system comprises two hooks 301 arranged along the lateral edges of the plate 208 and acting on the sides of the front end of the footwear 232 to lock the footwear to the plate 208. The plate 208 can be locked to the base 202 or can be uncoupled to allow the oscillation thereof with respect to said base in a manner which is fully similar to what has been described above.

The lateral hooks 301 are preferably in the shape of an inverted U, and each one is provided, in the upper region facing the footwear, with a longitudinal tab 302 adapted to engage with a seat 303 provided on the lateral edge of the front region of the footwear 232.

Figure 12:
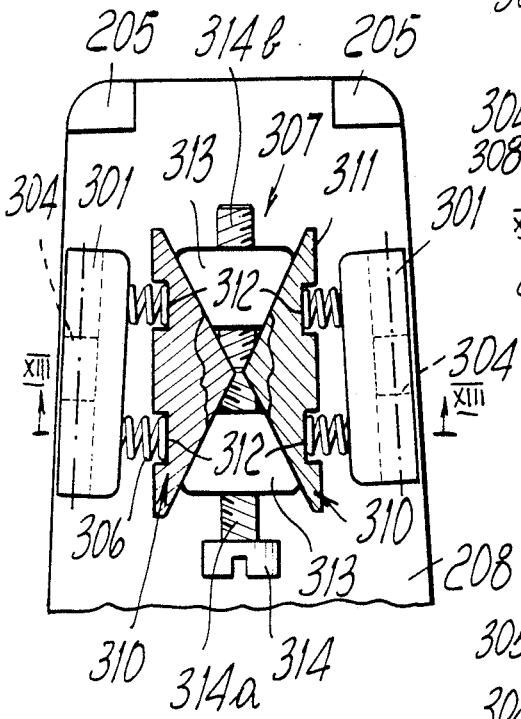
FIG. 12 is a schematic top view, partially in section, of the lateral binding system of FIG. 11.
Figure 13:
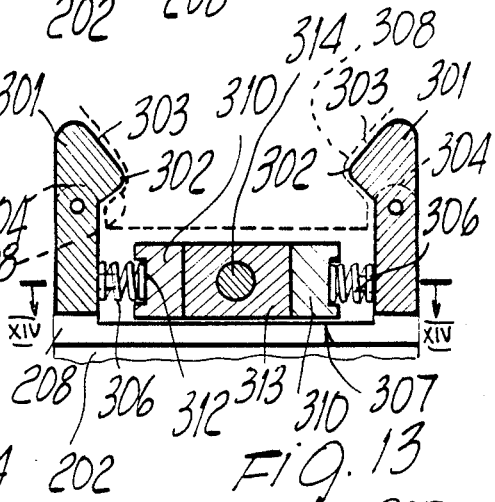
FIG. 13 is a schematic cross section view along the line XIII—XIII of FIG. 12.
Figure 14:
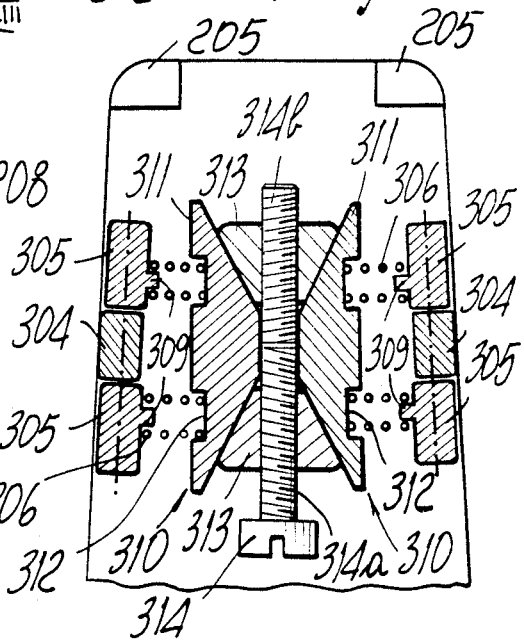
FIG. 14 is a schematic cross section view along the line XIV—XIV of FIG. 13.

The hooks 301 are pivoted, along a mid-longitudinal axis thereof, to two flaps 304 arranged symmetrically with respect to the lateral edges of the plate 202. The elastic elements 306 act on the two lower flaps 305 of each hook, their tension being adjusted by the adjustment assembly 307. With reference to FIG. 12, it can be seen that, since the pivoting axis of the hooks 301 is in an intermediate position between the lower flaps 305 and the longitudinal tabs 302, the tabs 302 press on the portion 308 of the sole 233, blocking the footwear 232.

The fastening adjustment system, of a known kind, is composed of the adjustment assembly 307 which acts on the elastic elements 306, which preferably are cylindrical helical springs, an end thereof being engaged with the flaps 305 by means of cylindrical tabs 309, and the opposite end being accommodated in suitable seats provided in the assembly 307.

The adjustment assembly 307 comprises two small blocks 310, substantially wedge-shaped, with the bases 311 facing towards the lower flaps 305 of the hooks 301 and provided with cylindrical seats 312 to accommodate the ends of the springs 306. Between the two small blocks 310, two wedge-like elements 313 are interposed, with their inclined faces in sliding contact with the inclined faces of the small blocks 310, so that by bringing together the wedge-like elements 313 the small blocks 310 approach the respective hooks 301, increasing the load of the springs 306. Conversely, by mutually moving apart the wedge-like elements 313 the small blocks 310 are allowed to mutually approach, increasing the distance between said small blocks and the respective hooks, and reducing the load of the springs 306.

The mutual motion of the wedge-like elements 313 is achieved by means of the adjustment screw 314, provided with counterposed threads **314*a* and 314*b* and inserted in threaded holes provided in the wedge-like elements 313 in a direction which is parallel to the longitudinal axis of the plate 208. By rotating the screw 314 in one direction, the mutual approach of the wedge-like elements 313 is achieved; conversely, by rotating the screw 314 in the opposite direction the mutual moving apart of said elements is achieved. The adjustment assembly 307 is expediently supported by a box-like housing for containment and protection, not illustrated herein for the sake of simplicity, similar in concept to the box-like housing 19** previously illustrated.

The operation of the lateral binding system is very simple, since it is sufficient to press the tip of the footwear 232 on the hooks 301 to cause rotation of the hooks about their axis of pivoting, since their upper surface is angled, thus allowing the insertion of the portion 308 of the footwear between said hooks. The binding is then adjusted, according to the weight of the skier and to his/her preferences, simply by rotating the screw 314 in one direction or the other. To unfasten the footwear, the plate 208 has to be locked on the base 202 and then the skier's heel sharply raised, the angled lower surfaces of the longitudinal tabs 302 and of the seats 303 facilitate the rotation of the hooks 301 against the action of the springs 306.

The lateral binding system allows a greater control of the ski, particularly in controlling the edge during the skid stride, also because of the fact that in this kind of binding the sole is coplanar to the fastening region.

A binding device has thus been provided which allows both to firmly fasten the footwear to the ski, and to allow it to perform an oscillating motion without the sole of the footwear being subject to any elastic deformation.

The particular guides provided below the sole of the footwear together with the lug 34 projecting from the ski allow an optimum control of the lateral thrust if the lateral push stride method of skiing is adopted.

It is stressed that the binding to which the present invention relates allows the achievement of optimum aesthetical characteristics. In fact, the footwear advantageously almost completely hides the binding from view.

Naturally, the invention thus conceived is susceptible to numerous modifications and variations, all of which are within the scope of the same inventive concept.

The materials and the dimensions of the individual components may also be any according to the specific requirements.

I claim:

1. In combination, a ski binding particularly for cross-country skiing and a ski boot, said ski boot comprising a sole having a downwardly protruding lug, and, tabs rigidly associated with said lug; said ski binding comprising a base having a first end and a second end and being attachable to a ski, a first pair of shoulders rigidly connected to said first end of said base, a second pair of shoulders rigidly connected to said second end of said base, a plate having lateral edges, at least one first end and at least one second end, said first end being pivotally connected to said second pair of shoulders, said second end being oscillable with respect to said base, means for blocking oscillation of said plate with respect to said base, control means adapted for operation of said means for blocking oscillation, a third pair of shoulders rigidly connected to said second end of said plate, at least one bar pivotally connected to said third pair of shoulders and being adapted for engagement with said lug for locking said ski boot to said plate, said bar having a substantially oval cross section and a mild longitudinal axis, and being pivotally connected to said third pair of shoulders at a pivot axis, said pivot axis being arranged eccentrically with respect to said mid longitudinal axis, a surface defined on said bar and being arranged facing said first end of said plate and adjacent to said lateral edges, seats provided on said surface defined on said bar and being adapted for engagement with said tabs, means for adjusting oscillation of said bar, and at least one arrestor tooth, projecting from said base and being adapted for cooperation with said bar for limiting rotation of said bar about said pivot axis.

2. A combination according to claim 1, wherein said means for adjusting oscillation of said bar comprise, a box-like housing rigidly associated with said plate and having inner walls, a screw having a stem, said stem being at least partially accommodated within said box-like housing and having an end, an annular seat defined on said inner walls of said box-like housing proximate to said end of said stem, a ring accommodated with said screw and being accommodated in said annular seat, a nut having lateral surfaces and being associated with said stem, said lateral surfaces interacting with said inner surfaces of said housing to allow only translatory motion of said nut, and an elastic element acting between said nut and said bar.

3. A combination according to claim 1, wherein said means for adjusting oscillation of said bar comprise a box-like housing rigidly associated with said plate and having inner walls, a screw having a stem, said stem defining a diameter, being at least partially accommodated within said box-like housing and having an end, an annular seat defined on said inner walls of said box-like housing proximate to said end of said stem, a ring accommodated with said screw and being accommodated in said annular seat, a nut having lateral surfaces and being associated with said stem, said lateral surfaces interacting with said inner surfaces of said housing to allow only translatory motion of said nut, and an elastic element acting between said nut and said bar, a longitudinal mid-axis and a plane of arrangement defined by said plate, a hole extending transversely through said bar above said longitudinal mid-axis of said plate and being inclined with respect to said plane of arrangement of said plate, said hole defining a diameter, said diameter of said hole being greater than said diameter of said stem, wherein said stem of said screw projects through and beyond said hole, and wherein said hole is inclined with respect to said plane of arrangement of said plate.

4. A combination according to claim 1, wherein said means for adjusting oscillation of said bar comprise, a box-like housing rigidly associated with said plate and having inner walls, a screw having a stem, said stem being at least partially accommodated within said box-like housing and having an end, an annular seat defined on said inner walls of said box-like housing proximate to said end of said stem, a ring accommodated with said screw and being accommodated in said annular seat, a nut having lateral surfaces and being associated with said stem, said lateral surfaces interacting with said inner surfaces of said housing to allow only translatory motion of said nut, and an elastic element acting between said nut and said bar, wherein said lug of said ski boot sole has a central section, and wherein said central section is shaped complimentarily with respect to said box-like housing.

5. A combination according to claim 1 wherein said means for blocking oscillation of said plate with respect to said base comprise, a tooth formed of each of said seats on said bar and having a planar surface, at least two flaps, rigidly associated with said base and located between said first pair of shoulders, at least one hook having an essentially L-shaped cross section and being pivotally connected to at least one of said first pair of shoulders and at least one of said flaps at a hook pivot axis, and adapted for releasably engaging said tooth, said planar surface of said tooth extending parallel to and between said pivot axis of said bar and said hook pivot axis.

6. A combination according to claim 1 wherein said means for blocking oscillation of said plate with respect to said hose comprise, a tooth formed at each of said seats on said bar and having a planar surface, at least two flaps, rigidly associated with said base and located between said first pair of shoulders, at least one hook having an essentially L-shaped cross section and being pivotally connected to at least one of said first pair of shoulders and at least one of said flaps at a hook pivot axis, said hook having at least one hook end and at least one other hook end, said one hook end being adapted for releasably engaging said tooth, a planar surface defined by said tooth and extending parallel to and between said pivot axis of said bar and said hook pivot axis, lower surfaces defined by said bar and said plate, guide seats formed on said lower surfaces of said bar and said plate, at least one rod axially slideable on said base in said guide seats and having at least one rod end and at least one other rod end, said at least one rod end being connected to said other hook end, a connecting rod having a first connecting rod end and a second connecting rod end, said first connecting rod end being pivotally connected to said other rod end, a lever attachment flap rigidly associated with said base, a lever having an intermediate portion, a first lever end, and a second lever end, said intermediate portion of said lever being pivotally connected to said second connecting rod end, said first lever end being pivotally connected to said lever attachment flap proximate to said second pair of shoulders, and elastic means acting between said base and said second lever end.

7. Combination according to claim 6, wherein, between said elastic means and said second lever end there is interposed a head, and wherein said base has rigidly associated therewith a fourth pair of shoulders, said head comprising a first head flap, a head stem, and a second head flap, said head stem being pivotally connected to said fourth pair of shoulders, said first head flap being pivotally connected to said second lever end, said elastic means acting between said second head flap and said base.

* * * * *